United States Patent [19]

Mauro

[11] 4,108,183

[45] Aug. 22, 1978

[54] DIFFERENTIAL HAIR CURLER

[76] Inventor: Peter Mauro, 355 S. Oyster Bay Rd., Plainview, N.Y. 11803

[21] Appl. No.: 805,830

[22] Filed: Jun. 13, 1977

[51] Int. Cl.[2] ..... A45D 2/14

[52] U.S. Cl. ..... 132/42 A

[58] Field of Search ..... 132/42, 43, 41, 38

[56] References Cited

U.S. PATENT DOCUMENTS

| | | | |
|---|---|---|---|
| 2,677,380 | 5/1954 | Schoendorf | 132/42 R |
| 3,080,873 | 3/1963 | Feist | 132/42 R |
| 3,141,463 | 7/1964 | Hatton | 132/42 R |
| 3,712,310 | 7/1973 | Parlagreco | 132/40 |

*Primary Examiner*—G.E. McNeill

*Attorney, Agent, or Firm*—Bauer, Amer & King

[57] ABSTRACT

To existing two-part hair curlers, wherein said one part is a small radius-sized cylindrical core member which provides correspondingly small-radius curls or waves, and said second part is a larger-sized outer cylinder which provides larger curls or waves, the within improvements include providing the two parts with a cooperating longitudinal slot and a radial projection which interfit during the telescoping of these two parts together, with the result that inadvertent unraveling of the hair in curled relation on the core is obviated and the strand of hair attached thereto is effectively guided into the slot and thus into a proper position to be wound about the outer unit preparatory to providing said large curls or waves.

1 Claim, 6 Drawing Figures

DIFFERENTIAL HAIR CURLER

The present invention relates generally to hair curlers which can effectively curl a single hair strand in two sizes or diameters of curls in adjacent length portions, and more particularly to improvements in said so-called differential hair curlers which significantly facilitate applying and using the curlers.

Hair curlers are already well known, as exemplified by the curler of U.S. Pat. No. 3,050,069, which effectively provide different size curls or waves. In a typical hair style, a significant number of these curlers may be used, and since each one requires curling the hair strand being styled first about a small diameter support, and then the remaining hair strand length about a second, larger diameter support the overall time and effort consumed in applying these type of curlers may be considerable. Nevertheless, these so-called differential hair curlers of the prior art are not particularly adapted to be readily applied; rather, they are in effect merely two rollers or curl-supports of different sizes which require twice the effort and time to apply that it takes for a single roller. In contrast, the improved hair curler hereof is so constructed that in the positioning of the outer curler unit over the inner or core unit, that the hair strand is properly positioned with respect to the outer unit for facilitated subsequent curling thereabout. The improved construction hereof provides other beneficial conditions which facilitate hair styling use of the curler, all as is subsequently described in detail.

An improved differential hair curler demonstrating objects and advantages of the present invention includes a core unit and an outer unit, both cylindrically shaped, and each of selected differently-sized diameter so as to bound an annular clearance therebetween for supporting small-radius turns of hair curled about said core unit. In use, large-radius turns of hair are curled about the outer unit. The improvements thereto consist of a radially extending projection on the core unit adjacent one end thereof, and a slot in the outer unit adapted to both slidably receive said core unit projection and also a strand of hair preparatory to the curling thereof about said outer unit. The seating of the projection in the slot prevents rotation of the core unit within the outer unit and thus any inadvertent unraveling of the strand of hair in its supported curled position on the core unit. Completing the curler is an elastomeric string adapted to be stretched in spanning relation between one end of the outer unit and a remotely located end of the core unit, and thus the string extends over the hair in its supported curled position on the outer unit. Thus, the position of the elastomeric string contributes to preventing any inadvertent unraveling of the hair and the urgency caused by its stretching maintains the core unit in its telescoped position within the outer unit.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 2A is a side elevational view illustrating the manner in which the small-radius curls are formed on the component which is the core of the curler;

FIG. 2B is also a side elevational view illustrating how the core unit with hair curled thereabout is inserted within an outer unit of the curler;

FIG. 2C illustrates the telescoped relation of the core unit within the outer unit and also how a strand of the user's hair is then in proper position for being curled about the outer unit;

FIG. 2D illustrates how the hair curled about the outer unit is prevented from unraveling.

Figure 1:
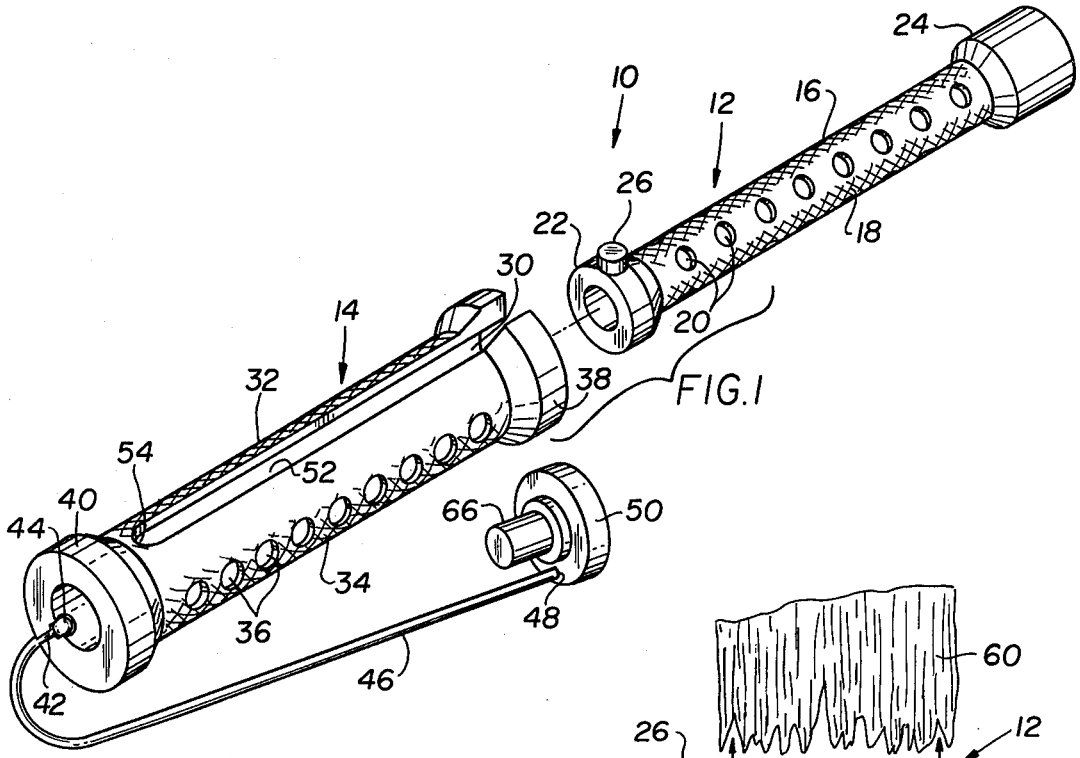
FIG. 1 is a perspective view of the disassembled components of the within differential hair curler from which the assembly thereof can be understood.

As understood, it is sometimes desirable in hair styling to have small-radius curls at the end of a strand of hair and visually noticeable large-radius curls in the upper portion of the hair strand that is near or adjacent the scalp. To this end, there is currently available so-called differential hair curlers, as exemplified by the hair curler of U.S. Pat. No. 3,050,069, which provides different-sized curls or waves along the same strand of hair. Such prior art differential hair curlers are generally comprised of two cylindrically shaped components, one being of a smaller diameter correspondingly serving as a circular support for the small-radius curls curled about it, while the other component serves a similar function for the remaining hair strand but, being of a larger diameter, produces large radius curls. The within hair curler, generally designated 10, is similarly comprised of two interfitting components or units 12 and 14, respectively, which achieve the desired result of producing differently-sized curls on the same strand of hair, but achieves this objective in a greatly facilitated manner due to improvements applied to these components, as will now be described in detail.

In the telescoping of the components together when forming the assembly which comprises the curler 10, component 12 is the core of such assembly. In a preferred embodiment, the core unit includes a hollow cylindrical barrel 16 of approximately ¼ inch diameter whose external surface 18 is advantageously knurled to enhance frictional engagement to a strand of hair which is wrapped or curled about it during use of the curler 10. Both for weight reduction and to accelerate drying of any hair curled about the barrel 16, it is provided with openings throughout, individually and collectively designated 20.

The barrel 16 of the core unit 12 is finished at its opposite ends with hollow hubs 22 and 24 of slightly enlarged diameter. A significant structural feature is provided on the hub 22 and consists of a radially extending projection 26, the function of which will soon be explained.

Cooperating with the core unit 12 is the outer unit 14, the cooperation therebetween consisting essentially of unit 14 being of an appropriately sized diameter to bound a cylindrical volume 30 big enough to accommodate the core unit 12 which is inserted into the compartment 30. Outer unit 14, like the core unit 12, has a barrel portion 32 whose exterior surface 34 is appropriately knurled and has spaced openings therein, individually and collectively designated 36. Outer unit 14 also has an enlarged diameter end hub 38 which bounds the opening into the compartment 30, and it is through this opening that the core unit 12 is inserted when the units 14 and 12 are telescoped together. At its opposite end, outer unit 14 has a hub 40 which is slotted, as at 42, and has disposed in it the knotted end 44 of an elastomeric string 46 which at its opposite end, as at 48, is appropriately affixed or connected to a plug-type member 50.

A significant structural feature embodied in the barrel 32 of outer unit 14 is a longitudinally oriented slot 52 that has an appropriate width for slidably receiving the radial projection 26 of the core unit 12. Thus during the telescoping of the core unit 12 within the outer unit 14, projection 26 is present in the slot 52 and allows movement for the length thereof until it seats against the slot back edge 54. By virtue of the projection 26 being operatively disposed in the slot 52 two noteworthy results are achieved. First, core unit 12 is prevented from rotating within the outer unit 14, and thus the length portion of the hair strand which is curled about the core unit barrel 16 is prevented from unraveling. Second, interfitting movement of the core unit 12 in relation of the outer unit 14 is guided by projection 26 sliding within the slot 52. In practice, this has been found to facilitate the movement of the hair strand attached to the core unit 12 into the slot 52, a position which is of course necessary preparatory to the subsequent curling thereof about the outer unit 14. In a typical hair styling procedure, a significant number of differential hair curlers 10 are utilized, and thus the savings in time as well as the simplified application of each hair curler 10 results in a significant overall benefit.

Figure 2A:
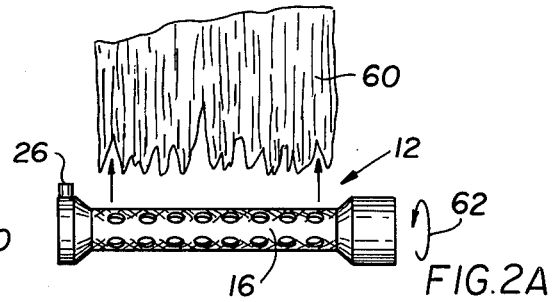
FIGS. 2A–2D illustrate the manner in which the small radius and large radius curls are formed on the hair curler. Specifically.
Figure 2B:
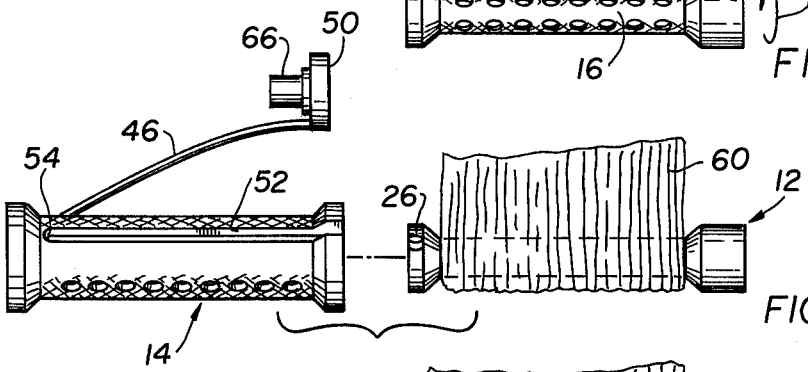

For completeness sake, a typical manner in which hair curler 10 is applied will now be explained in connection with FIGS. 2A–2D. The end of a hair strand 60 is placed upon the core unit 12, and more particularly on the barrel portion 16 thereof. Core unit 12 is then rotated in the illustrated direction 62 which in effect winds the core unit 12 up along a portion of the length of hair strand 60. After a selected number of turns, the outer unit 14 is then slipped in covering relation over the core unit 12, as illustrated in FIG. 2B. Specifically, slot 52 is aligned with projection 26, thus allowing movement of the outer unit 14 in covering relation over the core unit 12, the slot 52 during this time moving by the projection 26 until projection 26 abuts against the slot end wall 54. Because slot 52 is aligned with the projection 26, this is also helpful in guiding the walls which bound the slot 52 into a position on opposite sides of the hair strand 60.

Figure 2C:
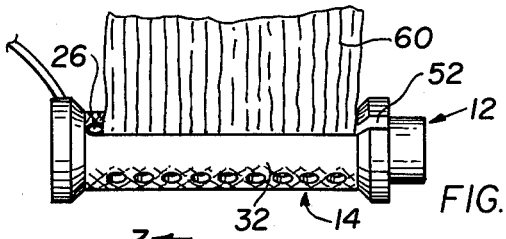

Ultimately the core and outer units 12, 14 assume the fully telescoped relation as illustrated in FIG. 2C in which the remaining uncurled length portion of the hair strand 60 extends from the core unit 12 through the slot 52, and is of a width generally coextensive with the width of the barrel portion 32 of the outer unit 14. As already noted, projection 26 in its seated position at the end of the slot 52 prevents rotation of the core unit 12 within the unit 14 and thus any unraveling of the end of the hair strand 60.

Figure 2D:
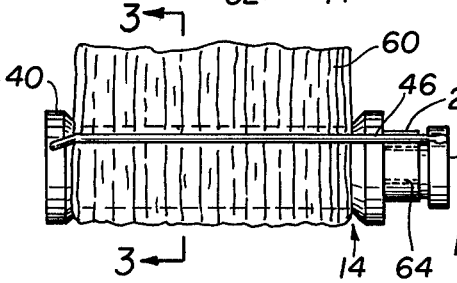

As a final step, and as illustrated in FIG. 2D, a selected portion of the remaining length of the hair strand 60 is wound in curled relation about the outer unit 14 and ultimately will result in large-radius curls or waves. While appropriate hair care fluid preparations are applied and allowed to perform their function, however, it is necessary that the hair curler 10 be retained in place.

To maintain the hair curler 10 in place until it is appropriate to remove same, and also to prevent inadvertent unraveling of the hair strand 60 from about the outer unit 14, an elastomeric string 46 is advantageously stretched in spanning relation over the outside of the hair curled about the outer unit 14 and is retained in this position by the insertion of the plug 50 into the end opening 64 of hub 24 of the core unit 12 which is appropriately sized to accommodate the cylindrical plug body 66. Thus, string 46 in its operative condition in spanning relation over the hair strand 60 extends between its end affixed to hub 40 and its opposite end affixed to plug 50 which is inserted in the remote end opening 64 of the inner core unit 12. Thus, not only does string 46 hold the hair strand 60 against unraveling, but the stretching which occurs in the string 46 produces an urgency along the length of the string 46 which contributes to holding the plug 50 in its seated position within the opening 64. This urgency in the string 46 contributes to holding the inner core unit 12 within the compartment 30 of the outer unit 14.

Figure 3:
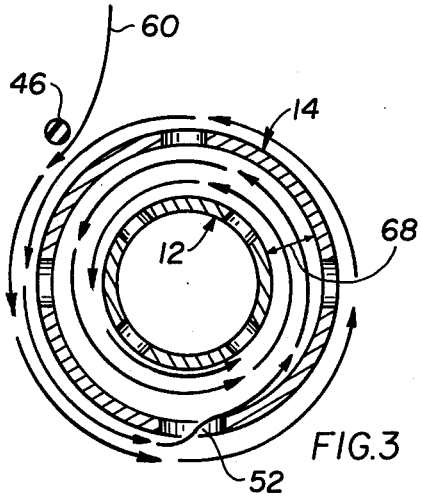
FIG. 3 is a side elevational view, on an enlarged scale, and in section taken along line 3—3 of FIG. 2D, illustrating further structural details.

Although it should be readily appreciated that the improved differential hair curler 10 hereof is not limited to any specific dimensions, in a preferred embodiment it has been found most practical to provide an outer unit 14 in a diameter size of $\frac{3}{8}$ of an inch as a cover for the $\frac{1}{4}$ inch diameter core unit 12. As best illustrated in FIG. 3, these differently-sized diameters thus provided an annular clearance 68 of a sufficient extent to accommodate several turns or curls of the hair strand 60. It will be understood, however, that the hair curler 10 hereof is not limited to the dimensions just noted. In other respects as well, a latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An improved differential hair curler of the type comprised of a hair-curling core unit and a cooperating hair-curling outer unit operatively arranged to be disposed in telescoped relation with each other, said core unit having an open-ended through bore and an outer hair curling diameter and said outer unit having a through bore larger than said core outer diameter so as to define a clearance space therebetween for supporting small-radius turns of hair curled about said core unit and a larger outer diameter to support large-radius turns of hair curled about said outer unit, the improvements thereto comprising a radially extending projection located on said core unit adjacent that end thereof which is inserted into said outer unit, said outer unit having a longitudinal slot therein open at one end thereof and adapted to both slidably receive said core unit projection for guided movement thereinto and closed at its other end to retain said projection therein and a strand of hair in curled relation about and behind said core unit projection preparatory to the subsequent curling of said strand of hair about said outer unit, said slot being bounded by side walls effectively confining said core unit projection therebetween so as to prevent rotation of said core unit within said outer unit and thus prevent any inadvertent unraveling of said strand of hair in said supported curled position on said core unit during the sliding of said core into said outer unit, and an elastomeric string connected to one end of said outer unit remote from said open end of said slot to extend in spanning relation between said one end of said outer unit and over to and into retaining engagement with the open end of the bore of said core unit adjacent said open end of said slot that is remote from said projection so as to be adapted to be stretched over the hair in said supported curled positon on said outer unit to engage over the same to prevent any inadvertent unraveling thereof and whereby the urgency in said stretched elastomeric string also maintains said core unit in said telescoped position within said outer unit with said projection maintained in the closed end of said slot and said core within said through bore of said outer unit.

* * * * *